US008858199B2

(12) United States Patent
Janesky

(10) Patent No.: US 8,858,199 B2
(45) Date of Patent: Oct. 14, 2014

(54) SUMP PUMP CONTAINER

(71) Applicant: Lawrence M. Janesky, Middlebury, CT (US)

(72) Inventor: Lawrence M. Janesky, Middlebury, CT (US)

( * ) Notice: Subject to any disclaimer, the term of this patent is extended or adjusted under 35 U.S.C. 154(b) by 0 days.

(21) Appl. No.: 13/657,049

(22) Filed: Oct. 22, 2012

(65) Prior Publication Data

US 2013/0042928 A1 Feb. 21, 2013

Related U.S. Application Data

(63) Continuation of application No. 10/978,643, filed on Nov. 1, 2004, now Pat. No. 8,292,602.

(51) Int. Cl.

| | |
|---|---|
| ***F04B 35/04*** | (2006.01) |
| ***F04D 29/42*** | (2006.01) |
| ***F04D 29/60*** | (2006.01) |
| ***F04D 29/70*** | (2006.01) |

(52) U.S. Cl.

CPC ..... *F04D 29/606* (2013.01); *F04D 29/426* (2013.01); *F04D 29/708* (2013.01)

USPC ..... 417/423.3

(58) Field of Classification Search

USPC ..... 417/423.3; 137/574; 220/DIG. 13, 796, 220/200, 553, 528, 507, 908; 206/446, 319

See application file for complete search history.

(56) References Cited

U.S. PATENT DOCUMENTS

| | | | | |
|---|---|---|---|---|
| 3,059,802 | A * | 10/1962 | Mitchell | 220/675 |
| 4,213,539 | A | 7/1980 | Reuter | |
| 6,308,924 | B1 * | 10/2001 | Janesky | 248/346.01 |
| 6,530,495 | B1 | 3/2003 | Joseph | |
| 7,534,098 | B2 | 5/2009 | Stirling et al. | |

* cited by examiner

*Primary Examiner* — Charles Freay
*Assistant Examiner* — Vikansha Dwivedi
(74) *Attorney, Agent, or Firm* — Perman & Green, LLP

(57) ABSTRACT

A sump pump reservoir is disclosed, the sump pump reservoir having a housing of oblong cross-section having an interior arranged for housing at least two level-activated water pumps supported on adjacent floor areas thereof for non-interfering operation, the housing having a length substantially greater than its width and the housing having a top oblong reinforcing rim; and a cover section enclosing the interior.

13 Claims, 5 Drawing Sheets

SUMP PUMP CONTAINER

CROSS-REFERENCE TO RELATED APPLICATIONS

This is a continuation of U.S. patent application Ser. No. 10/978,643, filed Nov. 1, 2004, which is incorporated herein by reference in its entirety.

BACKGROUND OF THE INVENTION

1. Field of the Invention

The invention relates to sump pump containers or sump liners which are sub-floor reservoirs for the reception of ground water which seeps into basements or other subterranean rooms. Generally the water is channeled to the sump reservoir and then pumped therefrom by a sump pump via a discharge conduit to an exterior location.

2. Brief Description of Related Developments

Sump pump containers or sump liners are designed for use in water control systems of the types disclosed in my prior U.S. Pat. Nos. 5,314,313, 5,501,044, and 5,927,955 for example.

In such systems, the sump pump container is a reservoir for the reception of the water seepage which is channeled thereto, and the conventional sump pump(s) contained therewithin include a water-level actuated lever arm switch which energizes the pump to discharge the water from the container whenever the water level reaches a predetermined height, as sensed by a float attached to the lever arm.

The size of the sump pump(s) incorporated within the sump liner container will vary depending upon the volume-discharge requirements of different installations and/or whether a battery-operated secondary pump is included to assure evacuation in the event of a power failure. If the sump pumps are too close to each other on the inner floor of the container their lever arms and floats can engage each other, the other pump, or the wall of the container and become inoperative. In such cases the container fills and overflows into the basement and/or rejects additional water before the occupant becomes aware that a problem exists, unless the system is provided with a water level-sensing alarm as disclosed in U.S. Pat. No. 5,314,313.

In the case of conventional sump containers for holding two or more sump pumps, generally at least one AC-powered pump and a battery-operated pump, the diameter of the floor of the container may be too small to receive two pumps, side-by-side, without interference with each other and/or with the wall of the container.

It is known to incorporate a sump pump stand in a sump basket to elevate the pump above the floor of the basket to prevent mud and debris from entering the pump, and reference is made to Pacquesi U.S. Pat. No. 5,249,930 for its disclosure of such a pump stand. The pump stand of the reference is integral, has a platform with a sloped upper wall or floor provided with circumferential openings, a central opening, supports for supporting the sump pump on the sloped platform floor, and legs for supporting the stand on the floor of the container basket.

My U.S. Pat. No. 6,308,924 relates to novel pump stands for a conventional circular-cross-sectional sump pump container for overcoming or avoiding the aforementioned problems, and for adapting the circular sump container to receive and support two or more large capacity AC sump pumps at different elevations or at the same elevation above the floor of the container where the diameter of the circular frustroconical container is sufficiently greater than the diameter of the circular floor of the container to accommodate the two pumps, side-by-side, sufficiently-spaced from each other and from the wall of the container to prevent interference.

The pump stand of U.S. Pat. No. 6,308,924 is an integral unit comprising a level, somewhat-circular platform having at least four spaced peripheral legs and at least two closely-spaced central legs, and a partition line on the platform for bisecting the pump stand into two similar half-stands, each having at least two peripheral legs and at least one central leg, which half-stands are stackable upon one another to support a sump pump at a greater elevation within a sump container, if desired.

While the pump stands of my U.S. Pat. No. 6,308,924 enable the use of two or more sump pumps at different heights within a conventional frustroconical container or reservoir, in which the inner diameter is greater as the distance above the circular floor increases, the need to use larger discharge-capacity pumps in many installations necessitates the use of larger diameter sump containers or reservoirs which requires a more extensive excavation of the concrete basement floor and sump pit and additional expense. A conventional regular frustroconical sump container has a top diameter of about 18" and a bottom or floor diameter of about 14". A conventional large frustroconical sump container has a top diameter of from about 24" to 26" and a floor diameter of from about 20" to 22". It is possible to use such a conventional, larger-diameter frustroconical sump container having a sufficient floor diameter, such as about 20-22 inches, to accommodate two sump pumps and/or pump stands on the floor without interference with each other or with the wall of the container. However, such a large-diameter container requires a huge excavation of the sump pit, generally in a concrete basement floor, with resultant labor, expense and loss of floor space. There is a need for a sump container having a smaller width and volume than conventional large frustroconical containers but having interior dimensions which accommodate two or more sump pumps of the required discharge capacity without interference with each other and/or with the interior walls of the container.

SUMMARY OF THE INVENTION

The present invention relates to novel oblong sump containers or reservoirs for containing sump pump stands and two or more sump pumps, which containers are more narrow, side-to-side, than conventional circular, frustroconical larger volume sump containers, and only slightly longer or wider lengthwise than such conventional standard-size containers, to provide a substantially larger interior bilobular cross-sectional floor area for the containment of two or more sump pumps without interference with each other.

The preferred sump containers of the present invention are ellipsoidal or non-circular in cross-section, having the cross-sectional shape of intersecting circles of equal diameters to provide a FIG. 8 or bilobular cross-section, having a lengthwise dimension substantially greater than the diameter of either of the intersecting circles, approximating the diameter plus the radius of each circle while having a maximum width, side-to-side, equal to the diameter of the intersecting circles. The present containers comprise integrated or intersecting frustroconical or cylindrical bodies having an interior bilobular floor area substantially greater than standard-diameter individual frustroconical or cylindrical containers in order to accommodate two sump pumps and/or pump stands on the integrated floor without interference with each other or with the wall of the container.

The bilobular cross-section of the present preferred containers provides two adjacent integrated circular floor areas, each having a diameter, side-to-side, at the points of integration of said floor areas, of about 14", i.e. the same as the floor areas of conventional sump containers, surrounded by frustroconical walls tapering up to a rim having a top diameter of about 18", at the points of integration of said rim. Thus, the individual bilobular container has two adjacent integrated pump compartment sections forming one bilobular compartment able to accommodate two adjacent sump pumps and/or pump stands, without interference on a bilobular floor having, the same diameter as a conventional container, thereby enabling the width of the sump pit excavation to be the same as that for a conventional frustroconical container, while the length of the excavation is only slightly greater, i.e., about 21".

BRIEF DESCRIPTION OF THE DRAWINGS

The foregoing aspects and other features of the preferred embodiments of the present invention are explained in the following description, taken in connection with the accompanying drawings, wherein:

FIG. 4(*b*) is a perspective view of the top side or face of the half section of the cover of FIG. 4(*a*) according to an embodiment of the present invention in which both half sections are identical;

DETAILED DESCRIPTION OF THE PREFERRED EMBODIMENT(S)

Figure 1:
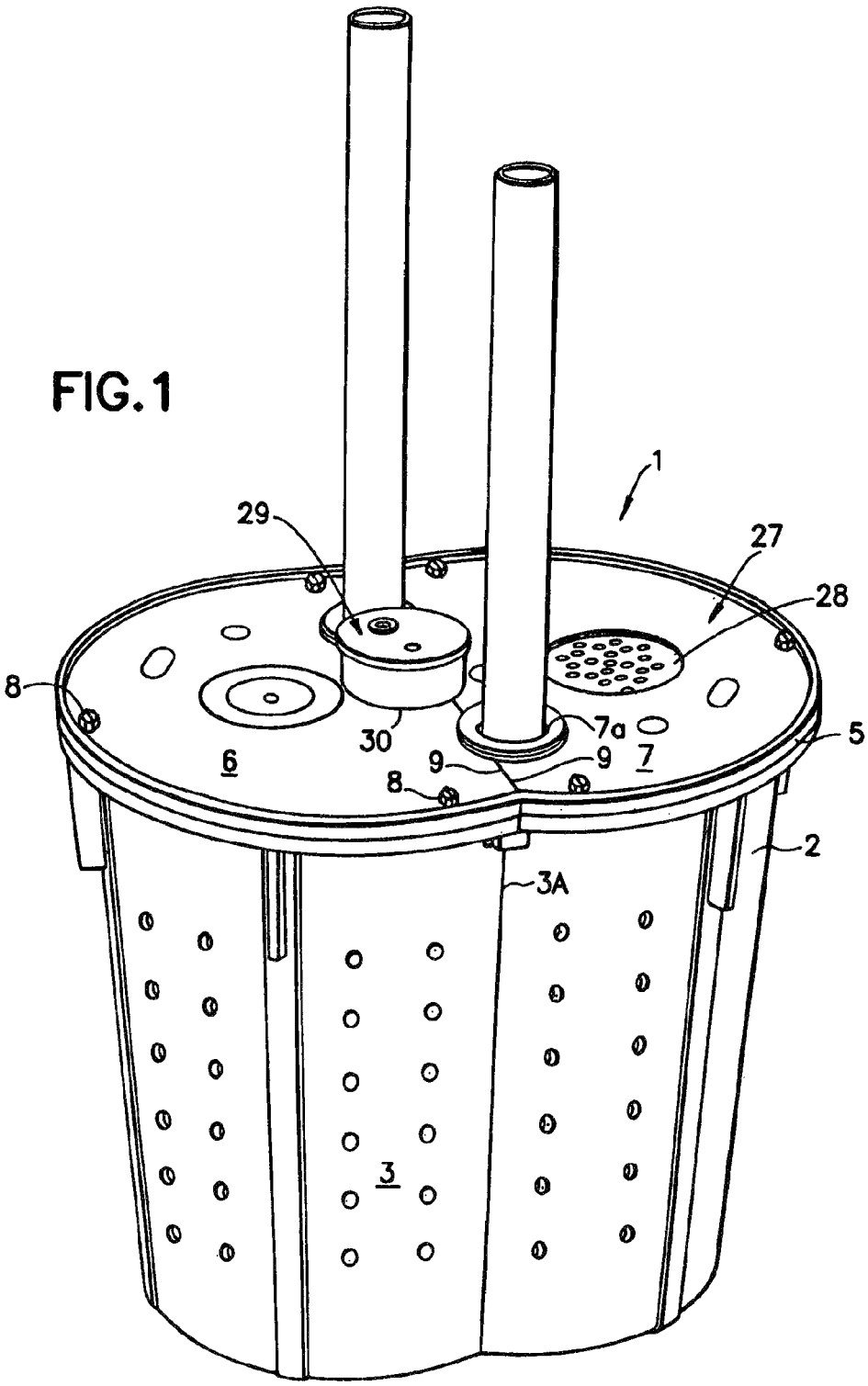
FIG. 1 is a perspective exterior view of a sump pump container according to an embodiment of the present invention.
Figure 2:
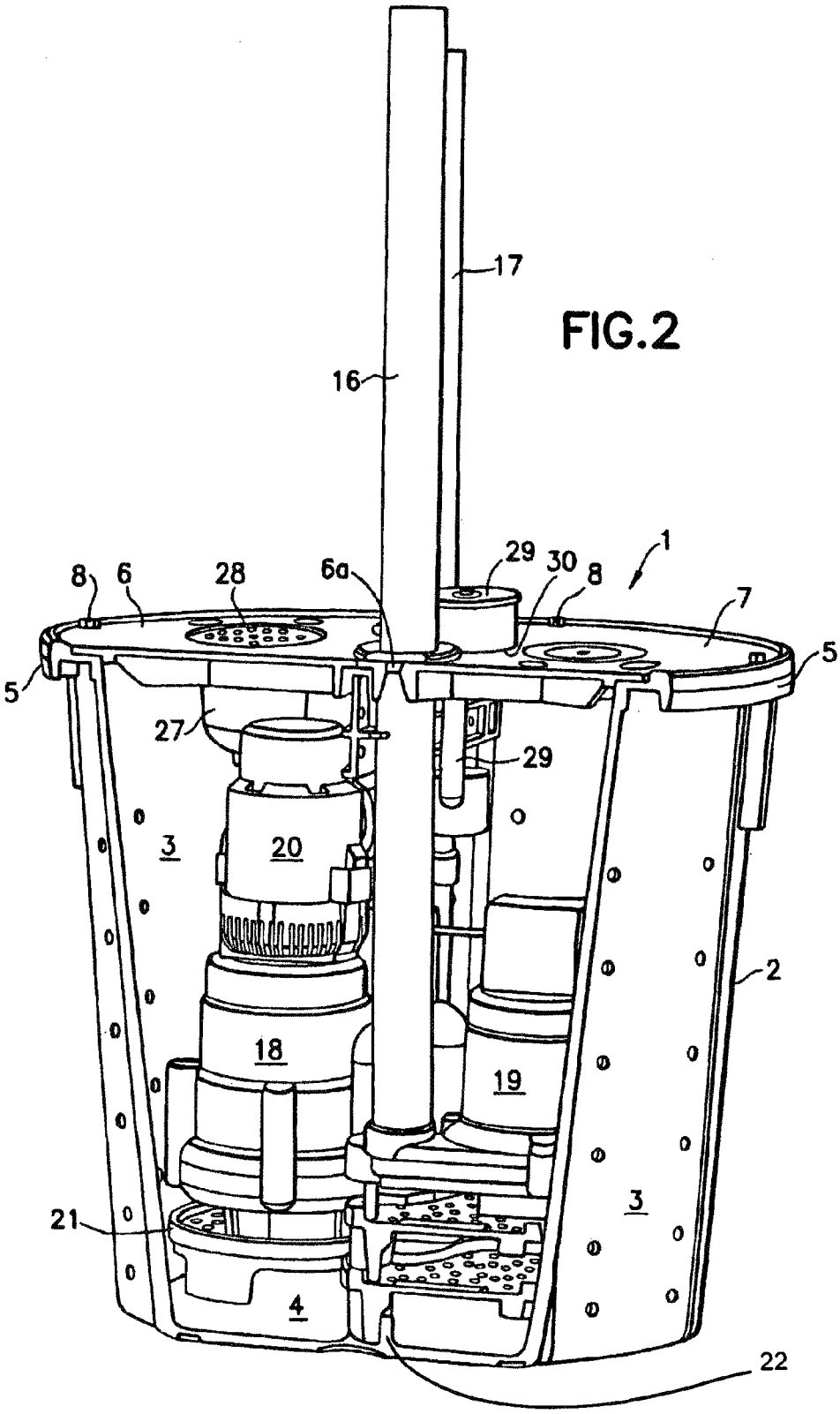
FIG. 2 is a perspective view of the sump container of FIG. 1, with the side wall partially cut away, to illustrate the sump pumps and pump stands mounted therewithin.

Referring to FIGS. 1 and 2 of the Drawings, the present sump pump assemblies 1 comprise a bilobular-cross-section container section 2 or reservoir section having an intersecting frustroconical bilobular wall 3, an elongate floor 4 and an upper peripheral reinforcing rim 5. The container section 2 is enclosed by a mating pair of identical cover sections 6 and 7 which are removably fastened to the rim section 5 by means of a plurality of spaced bolts or screws 8.

The cover sections 6 and 7 are identical truncated circular sections each having a straight edge 9 which mates with the other at the center of the assembly 1 to define the narrowest front-to-back width of the assembly 1, which is less than the diameter of the circular sections 6 and 7.

Figure 3:
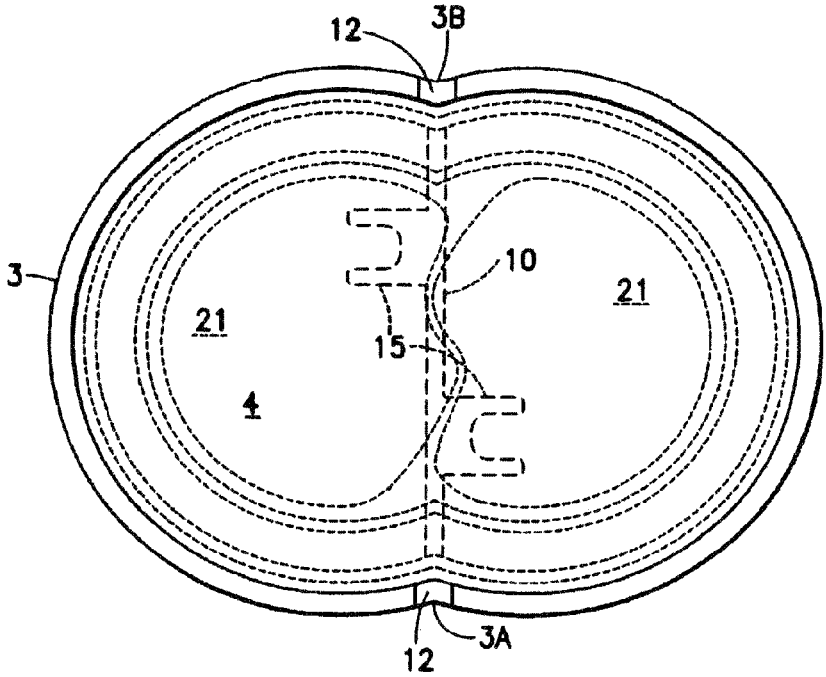
FIG. 3 is a top view of an empty sump pump container according to the present invention, with the cover removed to illustrate the outline of the rim portion and of the floor portion, and the locations of the positioning means for the legs of pump stands to be placed therein.
Figure 5:
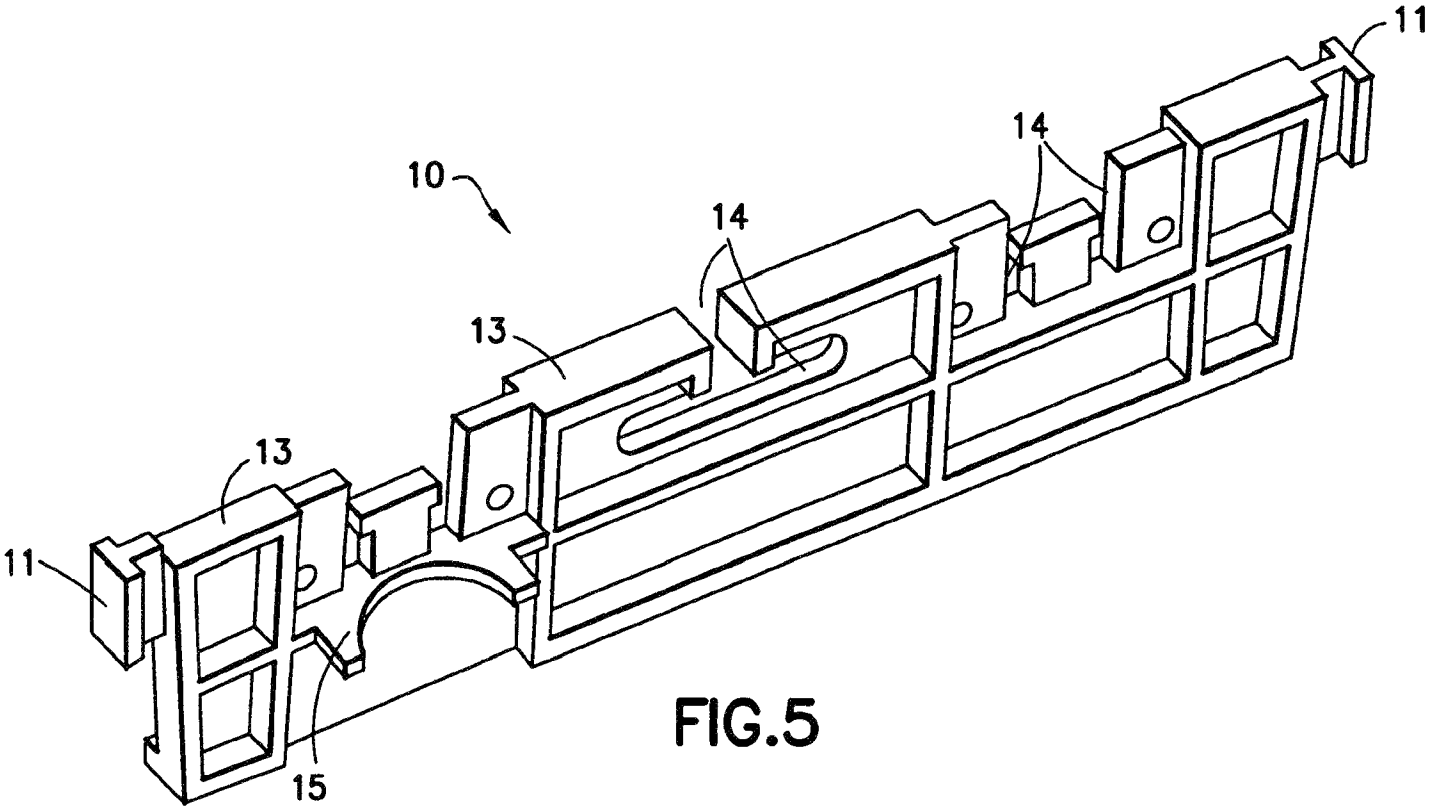
FIG. 5 is a perspective view of a support member bridge with engagement means for connection to the opposed side wall rims of the present sump container, across the narrowest side-to-side dimension of the top of the container, to prevent collapse or distortion, and having wire guide slots and half-round cradles for the water-discharge conduits and for alignment of the pumps.

The assembly 1 is provided with a transverse reinforcing brace bar or bridge 10 which has opposed finger members 11 which engage and lock into opposed vertical slot members 12 molded between the rim 5 and the container wall 3 at each end of the narrowly-spaced, opposed wall sections 3A and 3B, shown in FIGS. 3 and 5. The bridge 10, with the finger members 11 engaged within the slot members 12, holds the wall 3 of the container section 2 open so that it does not collapse or distort in the areas of wall sections 3A and 3B when back filling the sump pit during installation of the assembly 1. Furthermore, the bridge 10 is molded to have a narrow flat upper flange section 13 which provides support for the opposed mated edges 9 of the assembled cover sections 6 and 7. The bridge 10, as shown in FIG. 5, also has wire or tie-slots 14 and half-round cradles 15 for positioning and securing of the discharge conduits 16 and 17 extending out of the assembly 1 through a hole 6*a* or 7*a* in the cover, which is aligned with a cradle 15 when the pumps 18 and 19 (and 20 if present), are positioned as desired.

Figure 6:
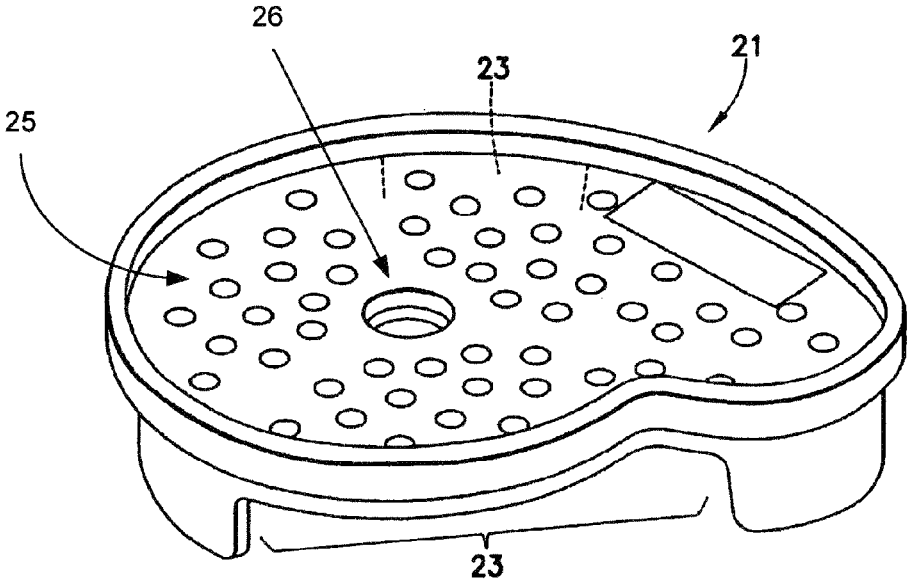
FIG. 6 is a perspective view of a stackable pump stand according to an embodiment of the present invention.
Figure 4A:
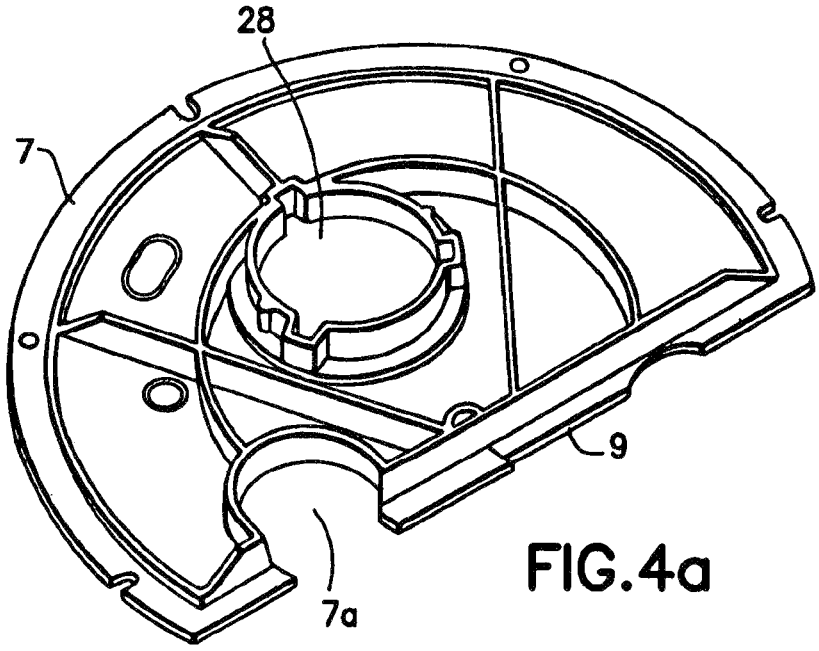
FIG. 4(*a*) is a perspective view of the underside of the half-section of the cover of a sump container according to the present invention.
Figure 4B:
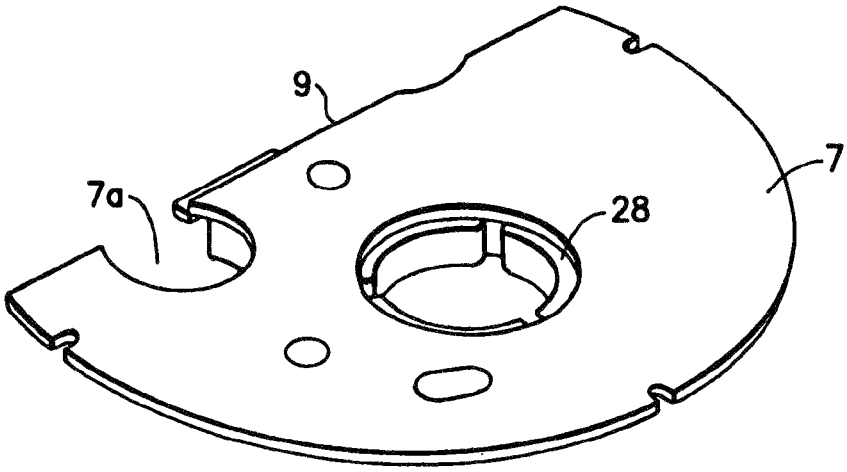

The pumps 18 and 19 are AC-powered pumps while the pump 20 is an optional battery-powered DC pump which may be included as a back-up in the event of power failure, and is supported "piggy-back" upon the lower AC-powered sump pump 18. Pump 18 is illustrated in FIG. 2 supported on the floor 4 of the container section 2 by means of a single pump stand 21, shown in FIG. 6. Pump 19 is illustrated in FIG. 2 supported at a higher elevation than pump 18 upon two pump stands 21 stacked upon one another. The pump stands 21 are designed and sized so that two such stands can be placed on the floor 4 of the container 2, side-by-side, without interference with each other as illustrated by FIG. 3 of the drawings. The floor 4 of the container 2 is preferably provided with molded retainer and positioning guides 22 spaced to receive the feet of the legs 23 of the stands 21 so that the stands 21 and the pumps 18 and 19 supported thereon are properly oriented to fit and operate within the container section 2 without interference. The floor 24 of each pump stand 21 is provided with a plurality of drain holes 25 to permit any mud, sand or other fine debris to drop down onto the container floor away from the pump inlets. A larger central drain hole 26 may be included, as shown in FIG. 6, to permit larger debris, such as small stones, to pass to the container floor 4. The large capacity AC-powered pumps 18 and 19 are supported on pump stands 21 at different heights above the floor 4 of the container 2 so as to activate at different times as and if the water level increases within the container. If the pumps 18 and 19 fail to operate, the rising water level eventually will activate the DC-powered water pump 20.

The present assemblies 1 may also include a one-way water-admitting, vapor and odor-blocking valve assembly 27 including a mounting opening 28 in the cover section 7, as shown in FIGS. 1, 2 and 4*a* and 4(*b*) and as described more fully in my U.S. Pat. No. 6,276,093.

The present assemblies may also include a water level-sensing alarm assembly 29 including a mounting opening 30 in the cover section 6, to activate an audible or other sensible alarm in the event of power-failure, as described more fully in my U.S. Pat. No. 5,314,313.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sump pump reservoir comprising:

a sump pump housing with a bilobular cross-section having an interior arranged for housing at least two level-activated water pumps supported on adjacent floor areas thereof for non-interfering operation, the housing having a length substantially greater than its width and the housing having a top oblong reinforcing rim; and a cover section enclosing the interior;

wherein the housing has through holes in side walls of each lobe of the bilobular cross-section and the interior of the bilobular cross-section forms two adjacent pump compartment sections such that each pump compartment section is configured to house at least one of the at least two level-activated water pumps and the cover section closes the interior so the cover section forms a gas tight seal with the housing.

2. The sump pump reservoir according to claim 1 wherein the at least two level-activated water pumps are arranged on different elevations in a respective lobe.

3. The sump pump reservoir according to claim 1 wherein the cover section includes a pipe penetration.

4. The sump pump reservoir according to claim 3 wherein the pipe penetration allows for fluids to pass through the cover section.

5. A sump pump reservoir comprising:

an oblong sump pump housing of bilobular cross-section having an interior arranged for housing at least two level-activated water pumps supported on adjacent integrated circular floor sections thereof for non-interfering operation, the housing having a bilobular floor and a top bilobular reinforcing rim comprising intersecting circular lobes of similar diameter that are connected to a respective portion of the bilopular floor by side walls to form the interior having side-by-side pump compartment sections where each of the side-by-side pump compartment sections is configured to house at least one of the at least two level-activated water pump; and a cover section enclosing the interior;

wherein, the housing further has through holes in each side wall of the circular lobes, a length substantially greater than the diameter and having a maximum width equal to the diameter, and a span between opposed points of intersection of the circular lobes which is less than the diameter and the cover section closes the interior so the cover section forms a gas tight seal with the housing.

6. The sump pump reservoir according to claim 5 wherein the at least two level-activated water pumps are arranged on different elevations in a respective pump compartment section.

7. The sump pump reservoir according to claim 5 wherein the cover section includes a pipe penetration.

8. The sump pump reservoir according to claim 7 wherein the pipe penetration allows for fluids to pass through the cover section.

9. A sump pump reservoir comprising:

an oblong sump pump housing of bilobular frustroconical cross-section having an interior arranged for housing at least two level-activated water pumps supported on adjacent circular floor areas thereof for non-interfering operation, the housing having a top bilobular reinforcing rim comprising intersecting circular lobes of similar diameter that are connected to a respective circular floor area by frustroconical walls to form the interior having side-by-side pump compartment sections where each of the side-by-side pump compartment sections is configured to house at least one of the at least two level-activated water pump; and a cover section enclosing the interior;

wherein the housing has through holes in each frustroconical wall of the circular lobes, a length substantially greater than the diameter and having a maximum width equal to the diameter, and a span between the opposed points of intersection of the circular lobes which is substantially less than the diameter and the cover section closes the interior so the cover section forms a gas tight seal with the housing.

10. The sump pump reservoir according to claim 9 wherein the at least two level-activated water pumps are arranged on different elevations in a respective pump compartment section.

11. The sump pump reservoir according to claim 9 wherein the cover section includes a pipe penetration.

12. The sump pump reservoir according to claim 11 wherein the pipe penetration allows for fluids to pass through the cover section.

13. The sump pump reservoir according to claim 1 wherein the through holes are configured for passage of ground water into the housing from outside the housing.

* * * * *